US005375720A

United States Patent [19]

Piggott et al.

[11] Patent Number: 5,375,720

[45] Date of Patent: Dec. 27, 1994

[54] DRY SEPARATION OF PARTICULATE MATERIAL OF DIFFERENT DENSITIES

[75] Inventors: Keith Piggott; Raymond J. Feuerriegel, both of Cairns, Australia

[73] Assignee: Resource Trend Pty. Ltd., Queensland, Australia

[21] Appl. No.: 730,878

[22] PCT Filed: Feb. 12, 1990

[86] PCT No.: PCT/AU90/00051

§ 371 Date: Jul. 17, 1991

§ 102(e) Date: Jul. 17, 1991

[87] PCT Pub. No.: WO90/09246

PCT Pub. Date: Aug. 23, 1990

[30] Foreign Application Priority Data

Feb. 15, 1989 [AU] Australia ..... PJ2741

[51] Int. Cl.[5] ..... B07B 9/00

[52] U.S. Cl. ..... 209/44; 209/254; 209/476; 209/493; 209/494; 209/502; 209/505

[58] Field of Search ..... 209/44, 254, 352, 468, 209/469, 475, 476, 490, 493, 494, 502, 505, 507

[56] References Cited

U.S. PATENT DOCUMENTS

| | | | |
|---|---|---|---|
| 417,476 | 12/1889 | Dodge | 209/475 |
| 1,634,898 | 7/1927 | Delamater | 209/475 |
| 2,069,326 | 2/1937 | Peale, Jr. | 209/502 |
| 2,752,041 | 6/1956 | Clint | 209/475 |
| 3,367,502 | 2/1968 | Cravens | 209/467 |
| 4,294,693 | 10/1981 | Brennan | 209/466 |
| 4,319,995 | 3/1982 | Haight | 209/494 X |
| 4,898,666 | 2/1990 | Kelsey | 209/494 X |
| 4,998,986 | 3/1991 | Campbell | 209/44 |

FOREIGN PATENT DOCUMENTS

| | | | |
|---|---|---|---|
| 14534/83 | 4/1983 | Australia . | |
| 964463 | 5/1957 | Germany . | |
| 671569 | 5/1952 | United Kingdom . | |
| 9000090 | 1/1990 | WIPO | 209/425 |

*Primary Examiner*—Andres Kashnikow
*Assistant Examiner*—Joseph A. Kaufman
*Attorney, Agent, or Firm*—Nixon & Vanderhye

[57] ABSTRACT

An air concentrator for dry separation of gold and other heavy minerals from alluvial deposits comprises a housing having a number of open-topped chambers arranged in a ring-like configuration and surmounted by a screen having rings thereon forming annular arms radiating from a hub sweeps over the screen beds. Air under pressure is fed sequentially and cyclically to the chambers by a rotary valve located centrally of the ring of chambers. The deposit is fed over the hub and is swept outwardly over the beds on the screen by the wiper arms, where it is fluidized by pulses of air from the subjacent chambers enabling particles of gold and heavy minerals to settle down to the bottom of the beds by gravitational stratification, and if sufficiently small, pass through the screen for collection through spigots in the bottom of the chambers.

20 Claims, 7 Drawing Sheets

DRY SEPARATION OF PARTICULATE MATERIAL OF DIFFERENT DENSITIES

This invention relates to apparatus for the recovery of gold and other heavy minerals contained in dry alluvial and eluvial mining deposits. In particular, the invention is directed to an air concentrator for separating gold and other heavy minerals from such deposits.

BACKGROUND OF THE INVENTION

Most mining operations on alluvial or placer type deposits use "wet" gravity separation technology. That is, particles of gold and other heavy metals are separated from lighter weight dust and dirt by using a current of water. Although wet plant technology is usually sufficiently efficient to render mining operations profitable, it requires a large supply of water and also generates a large amount of debris. Consequently, wet gravity separators cannot be used in dry areas. Furthermore, dams are often required to be built to contain the environmentally hazardous slimes created by dirty water, adding to the cost of production. For environmental reasons, the use of large-scale wet separation plants is restricted or even prohibited in some countries.

To overcome such problems, air separators or concentrators, sometimes called "dry blowers", have been used for waterless recovery of gold and other heavy minerals from dry placer deposits. There are several categories of air concentrators or dry blowers, but most involve passing air through the deposit as it is conveyed along the concentrator to thereby separate heavy particles from lighter material. Apparatus such as bellows, fans and compressors are typically used to vary air flow through the deposit being processed, while vibrating feed devices, angled shaking tables and screens, gravity bypass methods, air tunnel devices and perforating moving belts are used to convey the deposit through the concentrator. Examples of known air concentrators or separators can be found in U.S. Pat. Nos. 2,752,041; 3,105,040; 3,080,056; 3,108,950; 3,207,306; 3,367,502; 4,294,693; 4,615,797; 4,642,180 and Australian patent application no. 14534/83.

Many concentrators, such as those described in U.S. Pat. Nos. 2,752,041; 4,615,797 and 4,642,180, are limited to small scale batch operations and are of limited application. Others may be suited to continuous or larger scale operations, but are invariably of expensive and complex construction with many moving parts, and generally require vibratory mechanisms to achieve high throughput of deposit. Such concentrators are not easily transported. As a result of these disadvantages, the known air concentrators have failed to find widespread user acceptance.

A common design feature of known air concentrators is that the deposit is processed as it passes along a generally linear path in single direction, e.g. down an inclined riffle board or longitudinally along a table. Consequently, known concentrators are generally of elongated configuration, and their throughput is limited by their maximum dimension.

Perhaps the most significant disadvantage of most known air concentrators or dry blowers is their low efficiency, i.e. poor concentration rates and relatively low recovery rates. Since, for any given deposit, the average grade of ore is generally constant, and as the price of gold and other minerals are fixed by the market, the only remaining variable which will determine whether a particular deposit is viable is production cost which, in turn, is directly dependant upon efficiency. Many deposits therefore, are not viable with known air separation plants of low efficiency.

It is an object of the present invention to overcome at least some of the disadvantages of prior art air separation plants by providing a relatively low cost, high volume, environmentally compatible, efficient air concentrator.

SUMMARY OF THE INVENTION

In one broad form, the present invention provides apparatus for dry separation of heavier materials from a mixture of particulate materials of different densities, comprising:

a housing having a screen thereon;

means for moving the mixture of materials across at least a portion of the screen; and means for creating a flow of air from beneath the screen through the mixture so as to at least partially fluidize the mixture of materials thereby enabling heavier materials to settle to the bottom of the mixture by gravitational stratification and pass through the screen if less than the size of the screen apertures;

characterized in that the housing comprises a plurality of open-topped chambers which are arranged in a ring-like configuration subjacent the screen, and which in use, are sequentially supplied with air under pressure on a cyclical basis whereby the portions of the screen above the respective chambers are pulsed with air flow successively and cyclically.

The apparatus is suitably used as an air concentrator or separator for recovery of gold and/or other heavy minerals from dry placer deposits and the like.

In the preferred embodiment, the housing is cylindrical in shape and is divided by radial walls into segments which form the chambers. Air under pressure is directed to each chamber successively by a rotary valve formed by a cylindrical or tubular casing located in the centre of the housing with the ring of chambers. The rotary valve has a vent at a predetermined circumferential location on the casing, and the bottom of the casing communicates with the source of pressurized air, typically a fan unit. The vent communicates with the inner opening of each compartment when it is aligned with said opening, otherwise the inner opening is effectively sealed by the cylindrical wall of the rotary valve casing. As the rotary valve rotates, pressurized air from the fan unit is directed through the vent to the chambers sequentially and cyclically. This design is very compact and economic as ducting is minimized and all space in the housing is utilised. In addition, the only principal moving part is the rotary valve, and the flow of air from the fan unit is continuous.

Each chamber is suitably provided with sloping bottom and/or sides so that heavy minerals falling therein are gravity fed to a spigot at the bottom of each chamber. Material passing through the spigots may be collected in any suitable manner. The spigots are of sufficient diameter to allow smooth flow of material therethrough yet small enough to not significantly reduce the air pressure in each chamber when pressurized via the rotary valve.

The screen is typically formed by an annular wedge wire screen which rests on the radial chamber walls of the cylindrical housing. A number of rings are provided on the screen to form annular beds in which particulate materials such as gravel etc. collect to form the screen beds. As each chamber is pressurized by the rotary valve, a puff or pulse of air flows upwardly through the beds over that chamber causing lighter material to lift while allowing heavier minerals such as gold to filter or percolate down through the fluidized bed and screen and into the chamber for collection through its spigot.

The moving means preferably comprises a wiper bar assembly located above the screen beds and having a plurality of off-centre radial arms connected to a central hub member. The mixture of materials is initially fed onto the hub member from where it falls onto an annular apron around the hub. As the hub member rotates, the wiper arms sweep around the top of the screen to spread the deposits falling onto the apron and maintain appropriate air bed environment. More particularly, the wiper bar assembly includes inner wiper arms which convey the materials from the apron to outer wiper arms which, in turn, spread the materials over the screen in a generally spiral trajectory. As the lighter material is lifted by the air pulses, it is bladed outwardly by the wiper arms, while the heavier materials settle down through the screen beds. As the particulate material mixture spreads radially, its rate of travel drops as it spreads over a larger area, thereby allowing a longer time for the heavier minerals to drop out and filter through the screen beds. The tailings are spread to the outside of the screen. Typically, a tailings trough is provided around the screen to collect the tailings for disposal.

The wiper bars are mounted to the hub member and the assembly is rotated by a suitable drive unit located within the hub member.

The wiper bar assembly is preferably mounted at its outer ends on rollers adjustably mounted on the outside of the cylindrical housing. The height of the wiper bars are adjusted to ensure correct height above the screen beds and to correctly condition the deposits material for maximum interaction with the fluidized screen bed.

In order that the invention may be more fully understood and put into practice, a preferred embodiment thereof will now be described with reference to the accompanying drawings.

DESCRIPTION OF PREFERRED EMBODIMENT

Figure 1:
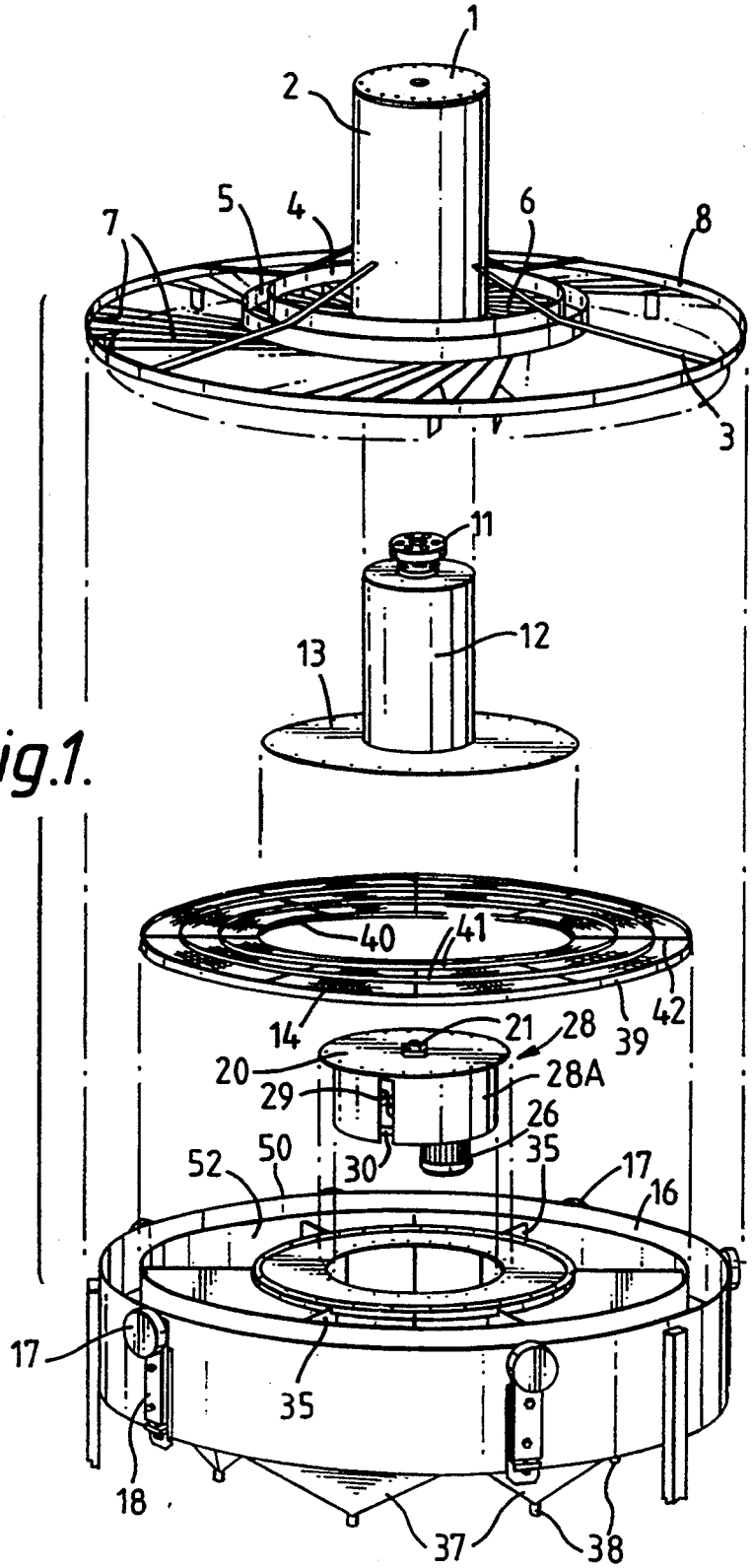
FIG. 1 is an exploded perspective view of the air concentrator of the preferred embodiment illustrating its assembly.

In its preferred embodiment, the air concentrator of this invention is a gravity separator using rotary wiper techniques for maintaining appropriate air bed environment and a rotary controlled air input for bed medium percolation and particle reaction, to provide continuous flow of concentrates through spigots below the air bed. The invention is particularly suitable for separation of gold from alluvial or placer deposits, although it is not limited thereto.

As shown in the drawings, particularly FIGS. 1–4, the air concentrator of the preferred embodiment comprises a circular housing (hereafter referred to as a "module") 50 having a circular channel 16 around its periphery. An annular portion of the module 50 within the channel 16 is divided by radial walls 35 into eight chambers or cells 52. The bottom of each cell 52 is provided with sloping slides 37 so that material within each cell is gravity fed to a respective spigot 38 opening downwardly.

Figure 5:
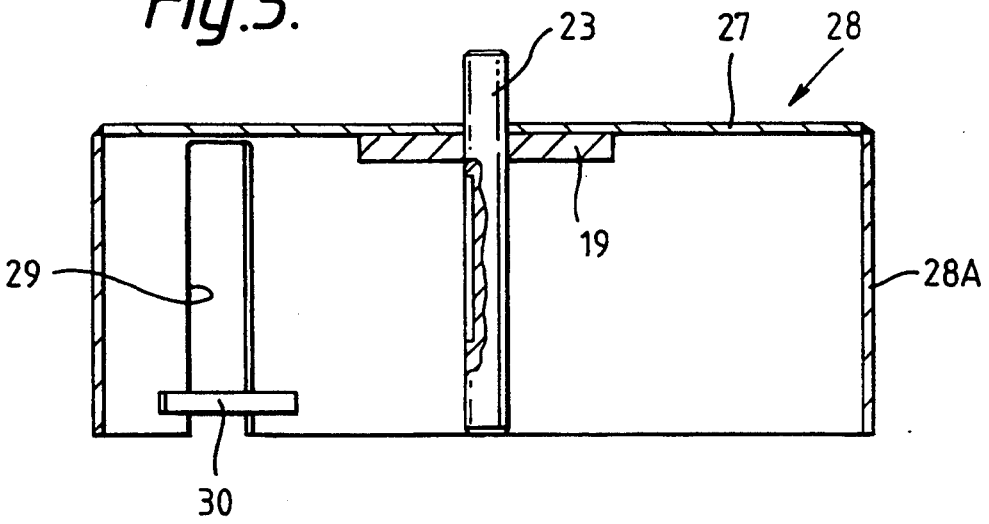
FIG. 5 is a part-sectional elevation of the rotor of the concentrator of FIG. 1.
Figure 6:
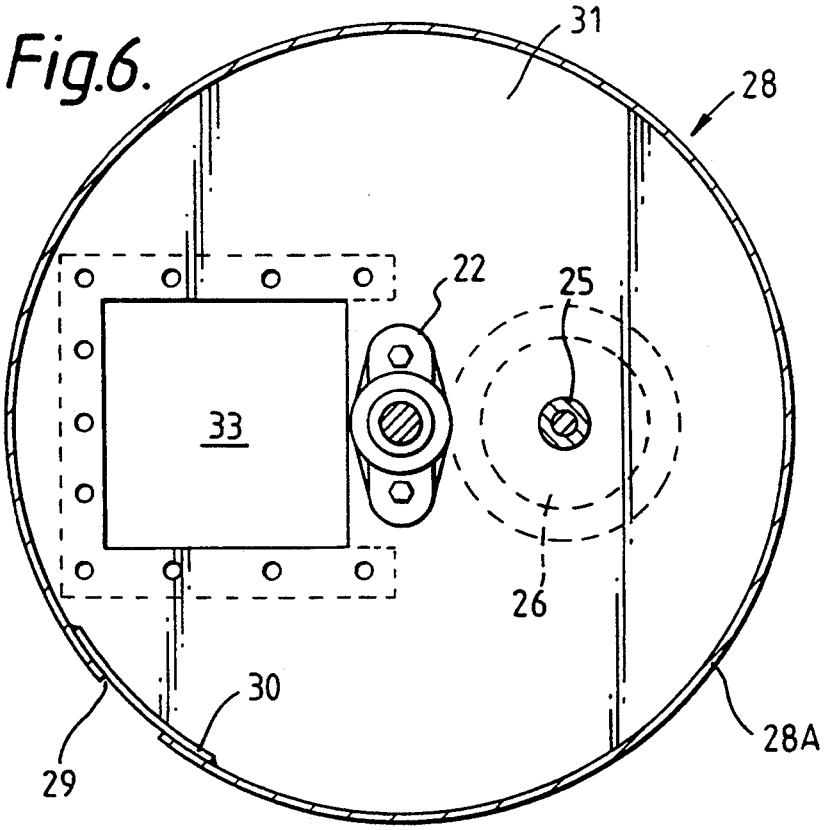
FIG. 6 is a sectional plan of the rotor of FIG. 2 along A—A.

A cylindrical rotor 28, shown in more detail in FIGS. 5 and 6, is provided in the centre of the module 50 and functions as a rotary valve to deliver air to each cell 52 sequentially, at a predetermined pressure, volume and frequency. Minimum clearance 34 is provided between the cylindrical casing 28A of the rotor 28 and the inner vertical edges of cell segment walls 35 so that each cell is in effectively sealed relationship with the rotor 28.

As shown more clearly in FIGS. 5 and 6, the rotary valve 28 comprises a rolled cylindrical casing 28A fitted with a top plate 27 which is mounted on shaft 23 by means of centre boss 19. A vent is formed in the casing 28A by a vertical slot 29 extending along the height of the cylindrical casing 28A, apart from a joining strip 30. The size of the vertical vent opening 29 is governed by the volume/pressure ratio required in the cells 52. The joining strip 30 is a strengthener at the aperture 29 and assists in balancing the rotary valve due to the absence of material at the slot 29.

Figure 2:
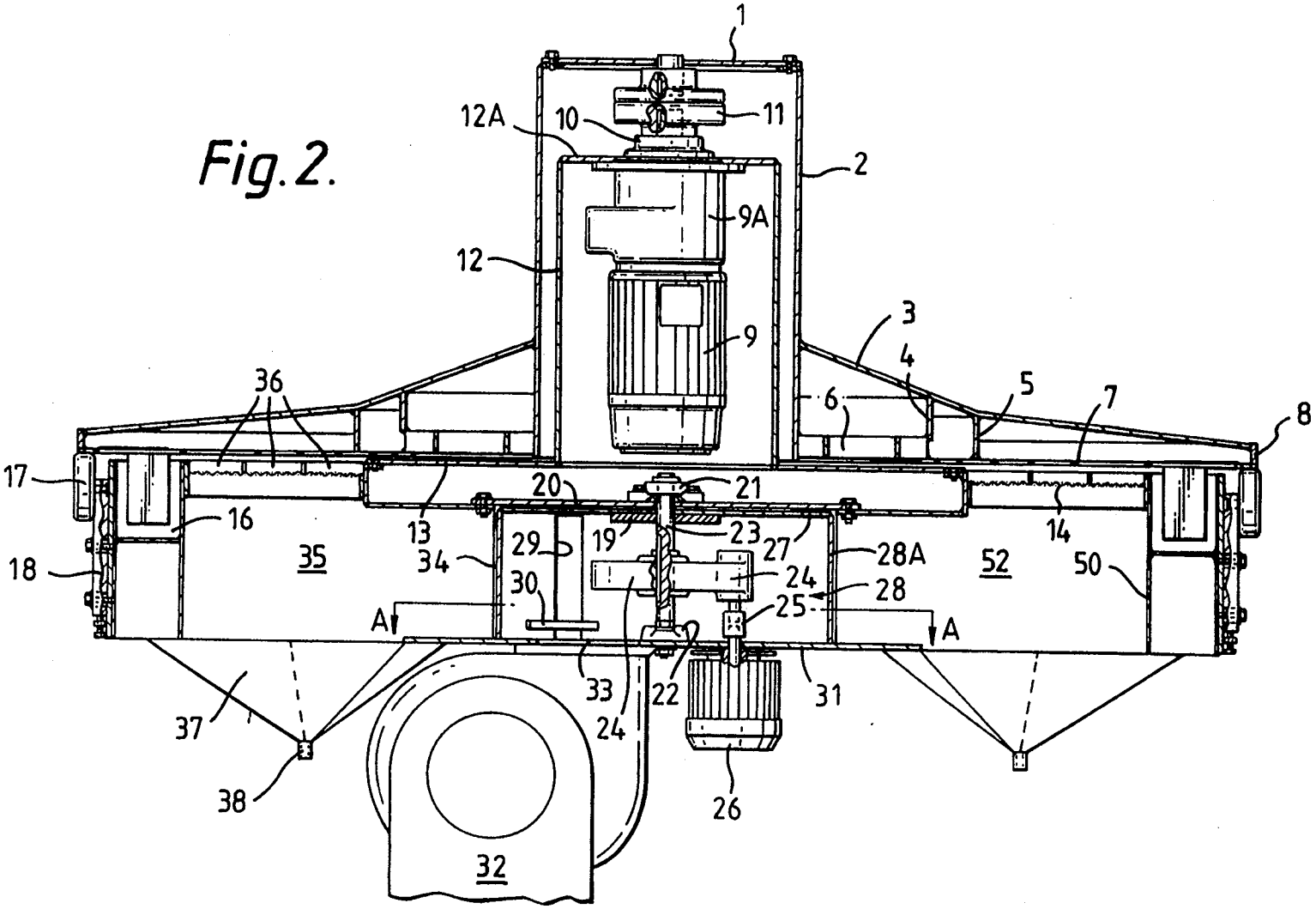
FIG. 2 is a part-sectional elevation of the concentrator of FIG. 1.
Figure 3:
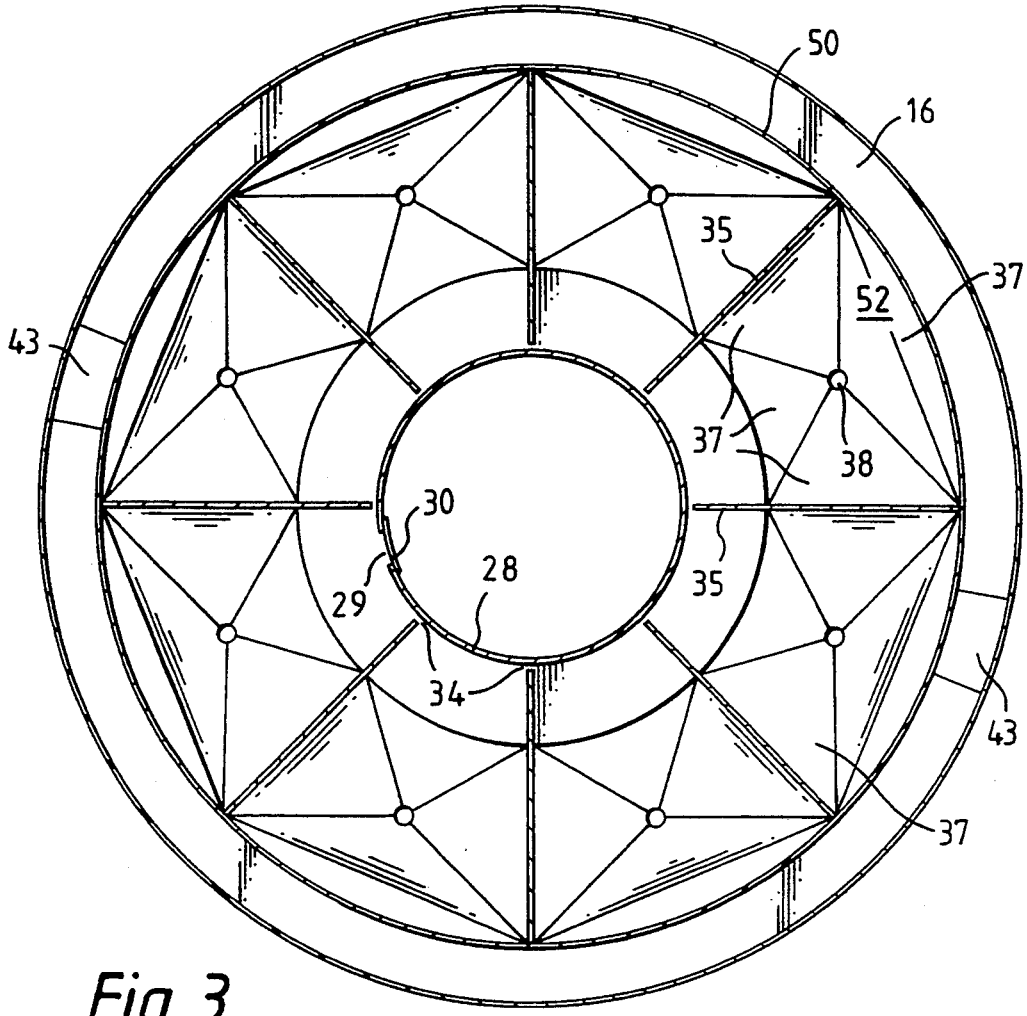
FIG. 3 is a schematic sectional plan view of the module and rotor of the concentrator of FIG. 1.
Figure 4:
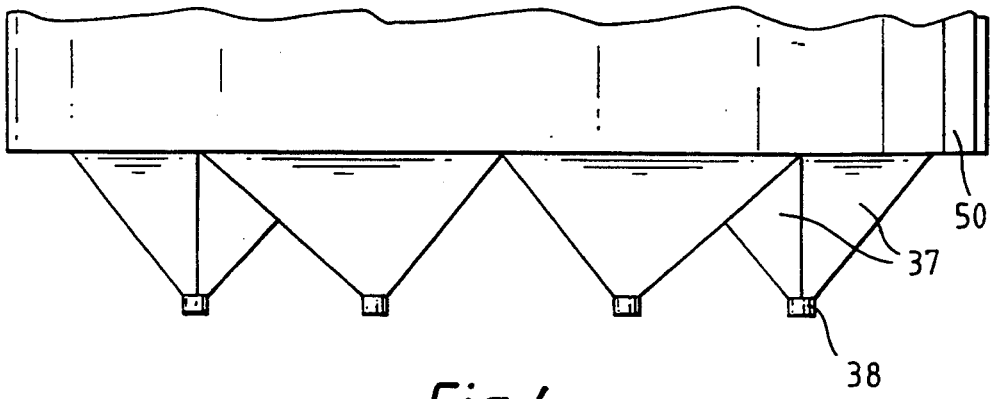
FIG. 4 is a schematic elevation of part of the module of FIG. 2.

Shaft 23 is mounted at its top and bottom in bearings 21, 22 located on mounting plate 20 and bottom plate 31 respectively (FIG. 2). The mounting plate 20 is fitted over the central aperture of module 50 and is bolted to the annular plate surrounding the central aperture. Bottom plate 31 is fixed to the bottom of the module 50, and an electric motor 26 is mounted to its underside. The cylindrical casing 28A and shaft 23 of the rotary valve 28 are rotated by the electric motor 26 via coupling 25 and mounted gearbox 24.

The rotary valve 28 is easily removed by unbolting the fasteners at the edge of the mounting plate 20 and the bolts which fasten bearing 22 to bottom plate 31. The coupling 25 simply slips out and the complete rotary valve assembly consisting of the cylindrical housing 28, gearbox 24, top plate 27, shaft 23 and bearings 21, 22 is able to be lifted out of the module (after removal of the wiper bar assembly and the inner top hat drive assembly as explained below). The clearance between the rotor top plate 27 and the mounting plate 20 of the module is also kept to a minimum and this is achieved by machining the rotary valve 28 and fitting the cell segment faces at construction.

A fan unit 32 (FIG. 2), which is mounted beneath the module 50 of the air concentrator by bolting to bottom plate 31, delivers air at substantially constant volume/pressure ratio to the rotary valve 28 via an opening 33 in the base of the module 50. (For clarity, the fan unit 32 is omitted from FIG. 1). The function of the rotary valve 28 is to direct the air at a constant volume/pressure ratio to each cell 52 sequentially at an appropriate constant frequency as the rotor 28 spins. The air is directed into the cells 52 by the vent aperture 29 in the cylindrical rotor 28 as it passes the inner radial aperture of each cell. That is, the vent 29 communicates directly with each cell 52 sequentially, and cyclically. The fan unit 32, rotor assembly 28 and cell 35 are very compact in design and little loss occurs in the delivery of air through minimal ducting. Air flow from the fan unit is continuous and substantially constant, thereby simplifying design criteria for the fan unit.

Figure 7:
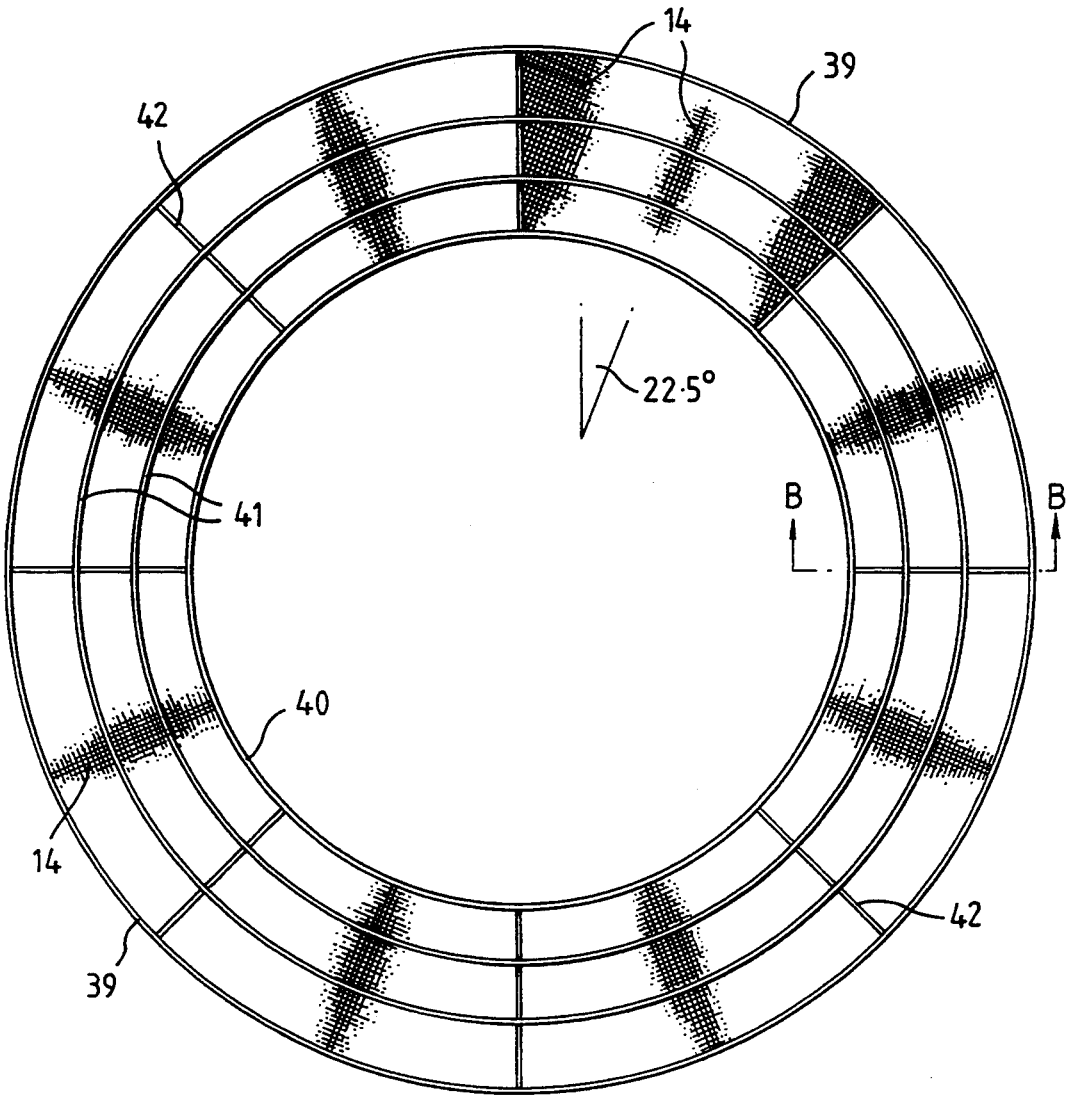
FIG. 7 is a plan of the screen of the concentrator FIG. 1.
Figure 8:
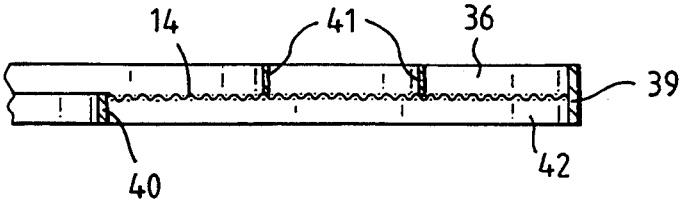
FIG. 8 is a sectional view of part of the screen of FIG. 7 along B—B.

An annular screen 14 (FIGS. 7 and 8) is mounted on the module 50 above the cells 52 as shown in FIGS. 1 and 2. The screen 14 comprises wire screen material arranged between outer and inner rings 39, 40. These rings sit on the tops of the cell walls 35. Radial support bars 42 of the screen 14 are aligned with respective cell walls 35 to mechanically seal with the tops of the cell walls 35. The screen 14 also includes spaced rings 41 which divide the screen into annular segments 36 which hold bed medium material. (The function of the bed medium is explained below). The rings 41 serve to restrict the flow of the bed medium in a radial direction across the screen.

An apron feed plate 13 (FIGS. 1 and 2) is mounted across the centre aperture of the module 52 to support a cylindrical housing 12 having a drive unit 9, such as an electric motor, mounted therein. The drive unit 9 is bolted to an adaption plate 12A which is welded to the top of the cylindrical housing 12. The drive unit/cylindrical housing assembly can be removed simply by unbolting the fasteners at the edge of apron 13. The drive unit 9 includes a reduction gearbox 9A which is supported by a thrust bearing 10 mounted on top of the adaptor plate 12A. A drive shaft from the gearbox 9A is connected to a hub assembly via cone coupling 11. Thus, in use, the hub assembly and its associated wiper assembly (described below) are rotated about cylindrical housing 12 by motor 9 via gearbox 9A and coupling 11.

The top plate 1 of the hub assembly and the top half of cone coupling 11 are removable by unbolting the fasteners at the outer edge of the plate 1. In this manner, the hub portion can be removed with the complete wiper bar assembly. Alternatively, the top plate 1 can be removed without the wiper bar assembly, if required.

Figure 9:
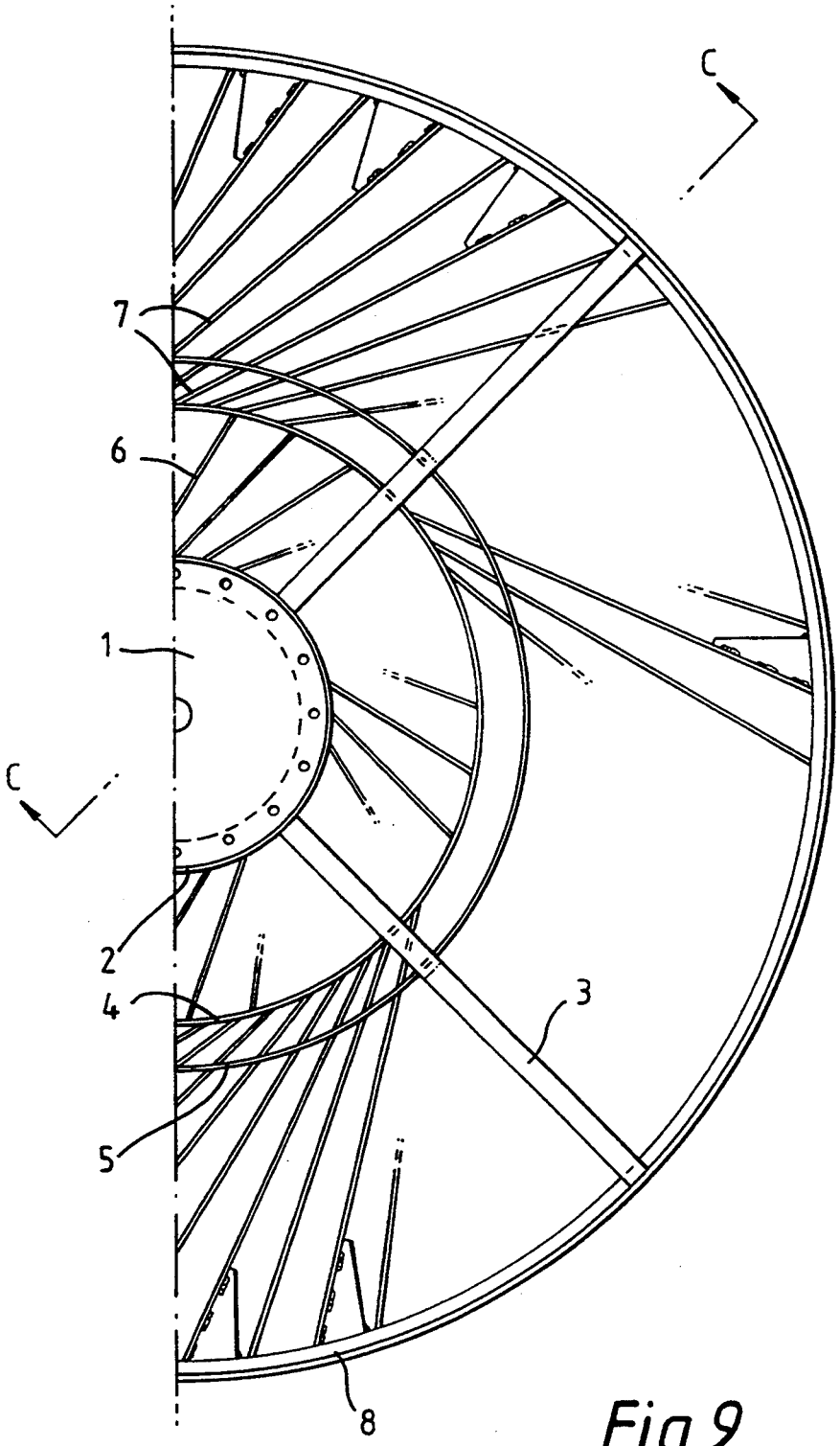
FIG. 9 is a half-plan of the wiper bar assembly of the concentrator of FIG. 1.
Figure 10:
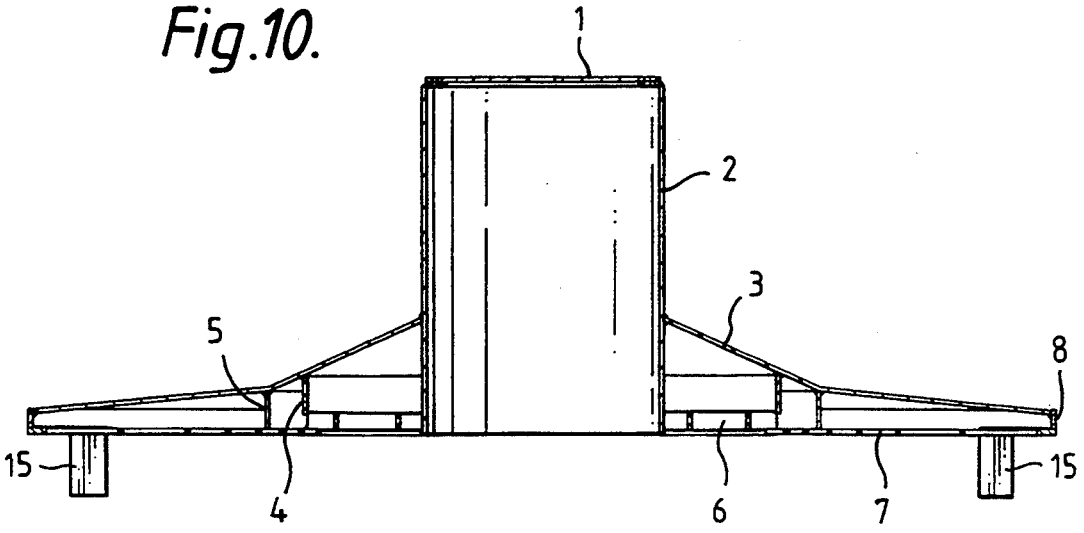
FIG. 10 is a sectional elevation of the wiper bar module of FIG. 9 along C—C.

A wiper bar assembly (FIGS. 1, 9 and 10) is mounted to the cylindrical portion 2 of the hub assembly, and comprises inner rings 4,5 and outer ring 8 supported by radial arms 3. The radial arms 3 provide support for the wiper assembly yet allow the required amount of flex. Off-centre radial apron feed bars 6 extend between the cylindrical casing 2 and the inner ring 4, while cell feed bars. 7 extend between the inner ring 4 and outer ring 8. The outer ring 8 is mounted for rotation on rollers 17 about the periphery of the cylindrical module 50 of the air concentrator. Each roller 17 is mounted on an adjustable mounting 18. The height of the rollers is set at the commissioning stage by adjusting the mounts 18 to ensure correct height of the apron feed bars 6 and the cell feed bars 7 relative to the apron 13 and screen 14, respectively. (Further minor adjustments may be required throughout the life of the wiper bars as minimal wear occurs.) Attached to the outer ends of wiper bars 7 and the outer ring 8 by means of support gussets are paddles 15. The paddles 15 convey tailings material along the channel 16 and through apertures 43 (FIG. 3) to a stacker conveyor or similar disposal method. Sufficient room is left between the paddles 15 and the walls of channel 16 so that running material sits on other material thus leaving the channel walls free of wear. The paddles 15 are easily replaced when maintenance is required.

Figure 11:
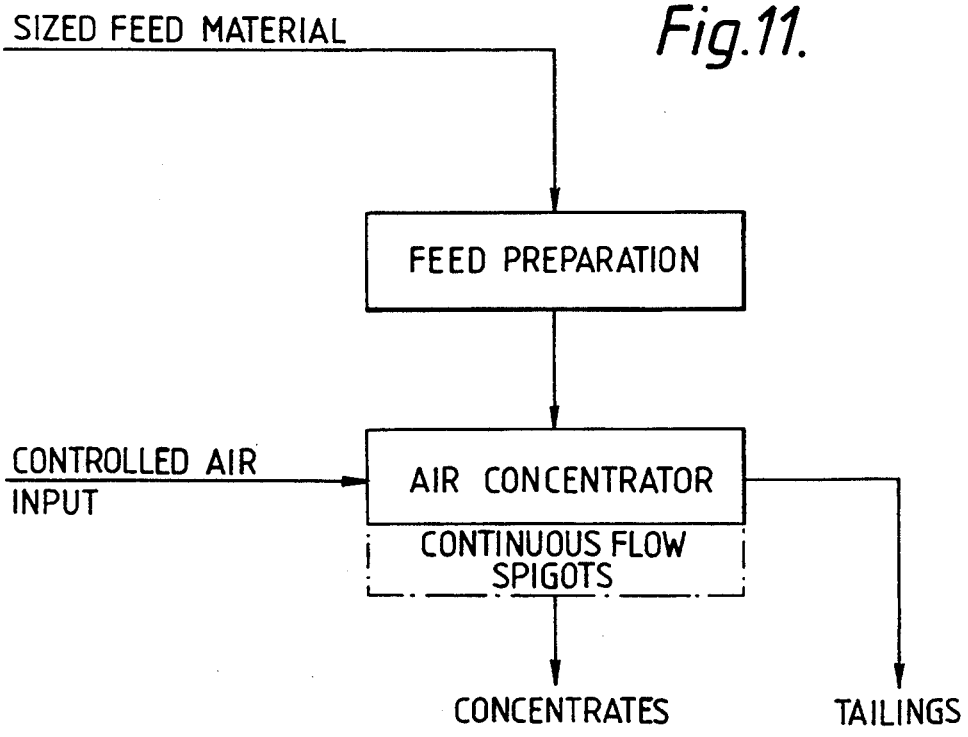
FIG. 11 is a flow chart for the operation of the concentrator of FIG. 1.

The operation of the air concentrator of the preferred embodiment will now be described with reference to the flow chart of FIG. 11 and the drawings of FIGS. 1 to 10. Material to be processed is introduced onto the top plate of the hub assembly 1 and falls onto the apron surface 13 in a continuous flow. The material is preferably sized prior to processing by the air concentrator, using a conventional screening plant. The size can vary depending on the nature of the ore being processed and the particle size of the minerals being recovered. As the material falls in bulk, it is initially retained by the inner ring 4 of the wiper bar assembly, but as the wiper assembly rotates, the apron feed bars 6 deliver the material at a constant rate to the annular section within ring 5. Ring 5, in conjunction with the wiper bars 7, controls the final feed rate and condition of feed onto the cell beds 36 formed between the rings 39, 40, 41 on the screen 14. The function of the wiper bars 7 is to keep the material in the cell beds 36 level and to keep the feed moving across the beds at a set thickness while tilling the material, causing the movement of gravel and mineral particles to react on the fluidized bed beneath.

The beds of material 36 over each cell 52 are fluidized by the "puffs" or pulses of pressurized air delivered by the rotary valve sequentially to the cells 52. These puffs lift the lighter material while allowing the heavier material to percolate down through the beds. The lighter material is bladed away by the angled wiper bars 7 as they rotate across the fluidized bed, while the heavy concentrates pass through the fluidized bed into the cells 52, and exit through the spigots 38 below the respective cells. The orifices of the spigots 38 are large enough to pass all the concentrates in a continuous flow yet restrict loss of air pressure within the cells 52 to an acceptable minimum. The wiper bar assembly therefore conditions the fluid bed continuously, preventing blow holes and maintaining optimum efficiency of the bed.

The screen 14 above each cell 52 excludes material other than that which is required to pass through the screen. Particles of bedding material will accumulate on the screen 14 to form the bed media 36, the particles of which range in size from above the aperture size of the screen to below the input size of the feed material. Further, the specific gravity of the bedding material is above the normal specific gravity of tails material and below that of the heavy minerals sought.

After a trajectory covering approximately three cells, the tailing material falls into the trough 16 and is carried away by paddles or rakes 15. The heavy materials pass through the fluid beds 36 and are continually bled off through the spigots 38 at the base of each of the cells 52. Larger heavy mineral particles or gold nuggets as such, which are larger than the screen aperture size, will remain in the bed material and can be recovered at leisure. Any buildup of larger heavier particles in the bed medium enhances the functioning of the air concentrator. However, in a practical field situation, the incidence of particles larger than screen aperture size is minimal.

The circular configuration has an inherent advantage in that it allows the progress of material across the bed to slow down as it spreads out over a wider area under the action of the wiper bars 6, 7. This contributes to the heavy minerals settling out when placed on an appropriate environment such as the fluidized bed.

Tests conducted on the illustrated embodiment of the invention have achieved a successful concentration rate of better than 100 to 1 and a recovery rate in excess of 90%. The circular design, although very compact, still allows a large throughput of material. Average throughput of material passing a 6mm screen is 20 cubic metres per hour per 2.5 metre diameter module.

The foregoing describes only one embodiment of the invention, and modifications which are obvious to those skilled in the art may be made thereto without departing from the scope of the invention as defined in the following claims. For example, the number of cells per module can be varied. Furthermore, the modules can be used singularly or in a group configuration, depending on the production required.

INDUSTRIAL APPLICABILITY

The invention is particularly suitable for recovering gold from alluvial and eluvial deposits. It should be noted that the invention is not limited specifically to this type of deposit but is applicable to any deposit which allows for dry separation of heavier particles from lighter material.

The air concentrator of this invention has a number of advantages over previously known air concentrators, including:

(a) The air concentrator is capable of a large volume throughput for its size in comparison to other "wet or dry" concentrators presently available. As air is far less dense than water, a much higher frequency percolation of the bed is obtained, thereby resulting in quicker settling of particles to a static position and subsequent reactivation with less lost time per cycle. Further, air has less molecular adhesion than water and does not carry away the very fine heavy particles, an unwanted effect which overrules the gravitational effect in wet concentrators. Hence far more material can cross the air bed efficiently than in lower frequency concentrators or batch types which have to be stopped on a regular basis and cleaned out of accumulated concentrates.

(b) The air concentrator has few moving parts. Only three principal components move, two of which (the rotor and fan) incur virtually no wear at all, while the third (the wiper system) only suffers wear on bars which are hardened and have quite a long life. The other secondary moving parts are the small rollers, motors and gear box drives which are lifetime units as such.

(c) As the concentrator has few moving parts, it requires low maintenance.

(d) The radial mode of processing the deposit allows for a compact design.

(e) The air concentrator has a simple construction consisting of mainly mild steel fabrication and utilizes a circular configuration for most of its structural components. The fan and drive units are bolt-on items.

(f) A high degree of ore concentration can be obtained, typically better than 100 to 1.

(g) Heavy minerals are extracted continuously as they are recovered from the primary ore, unlike many known air concentrators which are of a "batch" type and need to be shut down regularly to clear concentrates as necessary.

(h) The concentrator of this invention has a high recovery rate in comparison with other "wet" and "dry" processes presently available.

(i) The concentrator is easily transported, thereby making it suitable for low cost mobile mining in placer deposits where primary ore is shallow and constant moving is necessary to stay at the face of the deposit.

(j) By using air as the separating medium in preference to water, far less infrastructure is required, providing substantial savings in direct costs such as pipelines, pumps, dam construction, etc., and indirect costs such as delays in waiting for rain to fill dams and associated problems. (The other infrastructure directly related to the concentrator is a mobile power source to drive the unit.)

(k) The concentrator is not labor intensive to operate, and normally only one operator is required to feed the plant per shift.

(l) As a result of (a)–(k) above, production costs are reduced.

(m) The air concentrator is environmentally acceptable.

We claim:

1. Apparatus for dry separation of heavier materials from a mixture of particulate materials of different: densities, comprising:

a housing having a screen thereon, said screen having apertures and a top surface;

means for moving the mixture of materials across at least a portion of the top surface of the screen; and means for creating a flow of air from beneath the screen through the mixture so as to at least partially fluidize the mixture of materials so that heavier materials settle to the bottom of the mixture by gravitational stratification and pass through the screen if less than the size of the screen apertures;

said housing comprising a plurality of open-topped chambers which are arranged in a ring-like configuration subjacent the screen; and said means for creating an air flow further comprising means for sequentially supplying said chambers with air under pressure on a cyclical basis, so that the portions of the screen above the respective chambers are pulsed with air flow successively and cyclically.

2. Apparatus as claimed in claim 1, characterized in that the means for creating the air flow comprises a source of air under pressure and rotary valve means for receiving the air under pressure and directing it successively to the chambers.

3. Apparatus as claimed in claim 2, characterized in that the rotary valve means comprises a tubular casing mounted within the ring of chambers for rotation about its axis, the casing having a vent therein at a circumferential location and the interior of the casing being in communication with the source of air under pressure, whereby the air under pressure is directed through the vent to the chambers successively and cyclically as the casing rotates.

4. Apparatus as claimed in claim 3, characterized in that the housing comprises a cylindrical casing having a plurality of spaced radial walls extending between the casing and the rotary valve means to define the chambers, the inner edges of the radial walls being in substantially sealed relationship with the casing of the rotary valve means, and in that each chamber is provided with a sloping bottom having a spigot at the lower end thereof.

5. Apparatus as claimed in claim 1, characterized in that the screen comprises a plurality of ring members thereon forming annular channels on the screen which in use, retain therein part of the mixture of particulate materials to form beds of particulate materials which are at least partially fluidized by the pulses of air flow.

6. Apparatus as claimed in claim 1, characterized in that the moving means comprises a rotatable hub member located generally centrally of the screen and, a plurality of wiper arms extending outwardly from the hub member in a plane a predetermined distance above the screen, whereby on rotation of the hub member, the wiper arms cause the mixture of materials above the plane to move outwardly across the screen in a generally spiral projectory.

7. Apparatus as claimed in claim 6, characterized in that the moving means further comprises a plurality of ring members arranged concentrically around the hub member above the wiper arms, the heights of the ring members decreasing with diameter.

8. Apparatus as claimed in claim 7, characterized in that the screen is of annular shape and an annular planar portion is provided within the screen, wherein in use, the mixture of materials is fed onto the hub member and therearound onto the planar portion, and as the hub member rotates, the wiper arms between the hub member and the inner ring member cause the mixture of materials accumulated on the annular planar portion to move outwardly to the wiper arms between the outer ring members which, in turn, move the mixture outwardly across the screen.

9. Apparatus as claimed in claim 4, characterized in that said housing further comprises an annular channel around the exterior of the cylindrical casing into which the mixture of particulate material is caused to flow by the moving means after at least partial separation of heavier materials therefrom, the annular channel having at least one opening in the bottom thereof.

10. Apparatus as claimed in claim 9, characterized in that said moving means further comprises a plurality of paddle members spaced along its outer circumferential portion and extending downwardly within the annular channel, wherein in use the paddles urge material in the channel towards the opening(s) in the channel.

11. Apparatus as claimed in claim 6, characterized in that moving means further comprises drive means located within the hub member for rotating the hub member and the wiper arms.

12. Apparatus as claimed in claim 6, characterized in that the outer one of the ring members is connected to the outer ends of the wiper arms and is mounted on a plurality of roller spaced around the periphery of the housing.

13. Apparatus as claimed in claim 3, characterized in that the source of air under pressure is a fan, and further in that the rotary valve means delivers the air to each chamber at a substantially constant volume/pressure ratio.

14. Apparatus as claimed in claim 1, characterized in that the heavier materials include gold, and the mixture of particulate materials is obtained from an alluvial or eluvial deposit.

15. Apparatus for dry separation of heavier materials from a mixture of particulate materials of different densities, comprising:

a screen having apertures and a top surface;

means for moving the mixture of materials across the top surface of the screen;

means for creating a flow of air; and means for directing the flow of air upwardly through separate portions of the screen sequentially on a periodic basis to create pulsed air flow through the separate portions of the screen so that the pulsed air flow at each separate portion of the screen at least partially fluidizes the mixture of materials at that portion enabling heavier materials to gradually settle to the bottom of the mixture by gravitational stratification, and pass through the screen if the particles are of a size less than the size of the screen apertures.

16. Apparatus as recited in claim 15 wherein said screen is stationary and said means for creating a flow of air comprises a source of air under pressure, and wherein said means for directing the flow of air comprises a rotary valve means for receiving the air under pressure and directing it successively to the separate portions of the screen.

17. Apparatus as recited in claim 16 wherein said rotary valve means comprises a rotatable tubular casing mounted within the area defined by said screen, said casing having a vent therein at a circumferential location, and the interior of the casing being in communication with said source of air under pressure, so that the air under pressure is directed through said vent to said screen portions successively and cyclically as said tubular casing rotates.

18. Apparatus as recited in claim 15 wherein said screen is stationary and includes a plurality of ring members thereon forming annular chambers.

19. Apparatus as recited in claim 15 wherein said means for moving the mixture of materials across the screen comprises a rotatable hub member located generally centrally above the screen, and having a plurality of wiper arms extending outwardly from the hub in a plane, and spaced a predetermined distance above said screen, so that said wiper arms cause the mixture of materials to move outwardly across the screen in a generally spiral trajectory.

20. A method of dry separation of heavier materials, including gold, from a mixture of particular materials of different densities, including materials from an alluvial or eluvial deposit, utilizing a stationary screen having separate portions and uniformly sized apertures, comprising the steps of:

moving the mixture of materials across the screen; and directing a flow of air under pressure upwardly through the separate portions of the screen sequentially on a periodic basis to create pulsed air flow through the separate portions of the screen, so that the pulsed air flow at each separate portion of the screen at least partially fluidizes the mixture of materials at that portion, enabling heavier materials to gradually settle to the bottom of the mixture by gravitational stratification, and pass through the screen if of a size less than the size of the screen apertures.

* * * * *